United States Patent [19]

Kawakami et al.

[11] 3,987,255

[45] Oct. 19, 1976

[54] PICKUP-CARTRIDGE WITH MOVING MAGNET

[75] Inventors: Hirotake Kawakami, Tokyo; Shokichi Tatara, Yokohama, both of Japan

[73] Assignee: Sony Corporation, Tokyo, Japan

[22] Filed: Dec. 17, 1974

[21] Appl. No.: 533,489

[30] Foreign Application Priority Data

Dec. 22, 1973 Japan ..... 49-1371

[52] U.S. Cl. ..... 179/100.41 M; 179/100.41 K; 179/100.41 Z

[51] Int. Cl.[2] ..... H04R 11/12

[58] Field of Search ..... 179/100.41 M, 100.41 K, 179/100.41 Z

[56] References Cited

UNITED STATES PATENTS

| | | | |
|---|---|---|---|
| 2,507,708 | 5/1950 | Greener | 179/100.41 M |
| 3,538,266 | 11/1970 | Cho | 179/100.41 K |

FOREIGN PATENTS OR APPLICATIONS

| | | | |
|---|---|---|---|
| 686,858 | 5/1964 | Canada | 179/100.41 K |
| 897,323 | 5/1962 | United Kingdom | 179/100.41 K |

*Primary Examiner*—Bernard Konick
*Assistant Examiner*—Alan Faber
*Attorney, Agent, or Firm*—Hill, Gross, Simpson, Van Santen, Steadman, Chiara & Simpson

[57] ABSTRACT

A pickup cartridge having a cantilever with a stylus on the end and a magnet on the other end, with the magnet supported for pivotal motion and having a first magnetic means comprising a yoke with opposite ends of the first magnetic means mounted adjacent opposite sides of the north pole of the magnet, and a second magnetic means comprising a yoke having opposite ends adjacent opposite sides of the south pole of the magnet, and wherein portions of the first and second magnetic means are magnetically coupled together such that magnetic flux can freely travel between the first and second magnetic means, and wherein a pair of coils are mounted on one of the magnetic means such that the flux through the pickup coils always passes in the same direction.

9 Claims, 8 Drawing Figures

PICKUP-CARTRIDGE WITH MOVING MAGNET

BACKGROUND OF THE INVENTION

1. Field of the Invention

This invention relates in general to pickup cartridges and more particularly to an improved pickup cartridge of the moving magnet type.

2. Description of the Prior Art

Moving magnet type cartridges for use in record players which are hereinafter referred to as MM type comprise a cantilever arm with a stylus on one end made of diamond or sapphire and in which the stylus engages the sound groove on a record disc to pick up a signal recorded thereon and wherein the cantilever carries a permanent magnet at its other end which is attached to a resilient support such as a damper made of butyl rubber and is coupled to a magnetic yoke which has a substantially U-shaped cross section. A pair of pole pieces of the yoke are arranged to oppose the north pole of the permanent magnet and legs of the yoke connected to the pole pieces have wound thereon a pair of coils for converting the mechanical vibration of the cantilever into an electrical signal. The MM type cartridge thus formed can be represented by an equivalent magnetic circuit. For example, if the magnet to which the mechanical vibration is transmitted by the stylus and cantilever is represented as a battery then first, and second, third and fourth magnetic reluctances formed respectively by the air gaps between the magnet and the pole pieces are connected to both ends of the battery and the first to fourth magnetic reluctances are magnetically connected to the pair of pole pieces. Since the air gap at the side of the south pole of the magnet changes in response to the vibrations of the stylus, the third and fourth magnetic reluctances are variable.

In such magnetic circuit of the prior art, the first and third magnetic reluctances and the second and fourth magnetic reluctances are coupled at their ends by the pole pieces respectively, and if it is assumed that the stylus is moved, for example, downwardly such that the first magnetic reluctance becomes zero, then the first magnetic path from the north pole — the first magnetic reluctance — to the one pole piece, and the third magnetic reluctance to the south pole as well as in the second magnetic path from the north pole — the second magnetic reluctance, — the other pole piece, through the coils, — the third magnetic reluctance — to the south pole and both of these paths will be closed at the same time. In this event, the magnetic flux from the magnet does not pass through the second closed magnetic path including the coils, but will primarily pass through the first closed magnetic path. For this reason, all of the variations of the magnetic flux caused by the displacement of the stylus will not be transmitted to the pickup coils. Thus, cartridges of the MM type do not have sufficient sensitivity. This is because the first and third magnetic reluctances and the second and fourth magnetic reluctances are short circuited by the pole pices, respectively, to form the first closed magnetic path. It will be realized, of course, that when the stylus moves in the opposite direction from that assumed in the above case, the deterioration in sensitivity will also occur.

SUMMARY OF THE INVENTION

The present invention provides a pickup cartridge including a cantilever having a stylus at one end and a permanent magnet mounted on its other end and with a first magnetic member having ends mounted on opposite sides of a first pole of the magnet and a second magnet member having ends mounted on opposite sides of the other magnetic pole of the permanent magnet and with a pair of pickup coils mounted on either the first or second magnetic parts and in which the first and second magnetic parts are magnetically coupled together such that magnetic flux from the permanent magnet will always pass through the magnetic member on which the pickup coils are wound and such magnetic flux will always be in the same direction.

Thus, it is an object of the present invention to provide a novel pickup cartridge which has much greater sensitivity than the cartridges of the prior art.

Another object of the invention is to provide a pickup cartridge in which magnetic flux passes through a magnetic member having coils mounted thereon such that the leakage of the magnetic flux is reduced and the output is substantially increased.

Another object of the present invention is to provide a pickup cartridge in which magnetic flux passes through a magnetic yoke in one direction and is converted into an electrical signal so as to improve the sensitivity and linearity.

Yet another object of the present invention is to provide a pickup cartridge which is simple in construction and can be manufactured at low cost.

Other objects, features and advantages of the invention will be readily apparent from the following description of certain preferred embodiments thereof taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
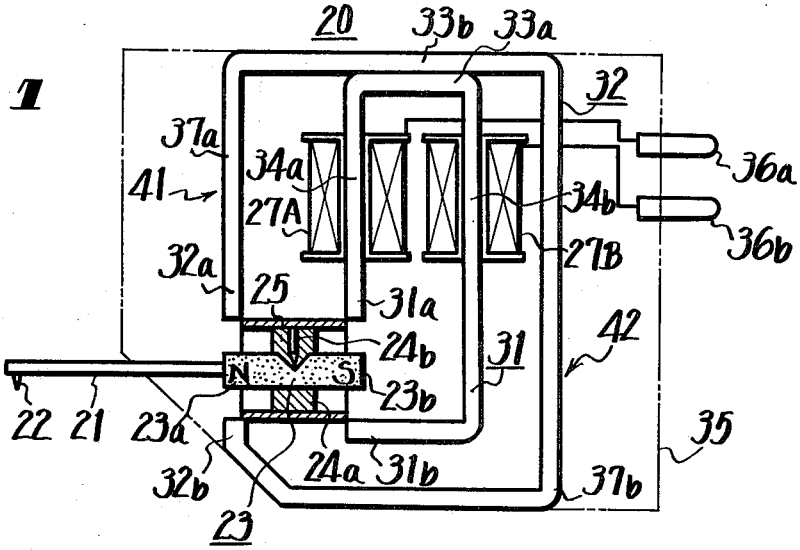
FIG. 1 is a theoretical constructional diagram showing an embodiment of the pickup cartridge according to the present invention.

FIG. 1 illustrates a pickup cartridge 20 of the invention, in which a cantilever 21 has stylus 22 at one end and carries a permanent magnet 23 at its other end. The permanent magnet 23 is supported with its vibration fulcrum at the center point thereof relative to its longitudinal direction. A vibration damper **24*a* supports the permanent magnet 23 and a pivot support shaft 24*b* provides the vibration fulcrum of the magnet 23. The pivot support shaft 24*b* is attached to the inner surface of a large cylindrical sleeve 24** shown in cross-section in FIG. 1, which may be constructed of magnetically insulating material, as for example, brass.

A first magnetic member 31 comprises a yoke of somewhat C-shape which has ends 31*a* and 31*b* which are mounted adjacent opposite sides of the south pole 23*b* of the magnet 23 with predetermined air gaps therebetween, as shown. The member 31 also has intermediate leg portions 34*a*, 33*a* and 34*b*, as shown.

A second magnetic member 32 is generally C-shaped, and has opposite ends 32*a* and 32*b* on opposite sides of the north pole 23*a* of the magnet 23. The member 32 also has intermediate legs 37*a*, 33*b* and 37*b* as shown.

The first and second magnetic members 31 and 32 are mounted with their legs 33*a* and 33*b* adjacent and bonded to each other as, for example, by a bonding agent having low magnetic reluctance so that they are magnetically coupled together, as shown. A pair of pickup coils 27A and 27B are respectively wound on legs 34*a* and 34*b* of the first magnetic member 31, as shown. A shielding case 35 which provides an external shield surrounds the pickup cartridge and the magnetic members 31 and 32, as shown. A pair of output terminals 36*a* and 36*b* extend from the pickup cartridge 20 and are respectively connected to the coils 27A and 27B, respectively.

Figure 2:
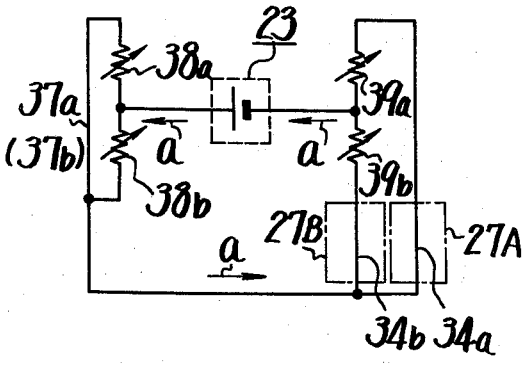
FIG. 2 is a view of an equivalent magnetic circuit of the pickup cartridge shown in FIG. 1.

FIG. 2 comprises a magnetic schematic of the pickup cartridge 20 illustrated in FIG. 1. The magnetic reluctances 38*a* and 38*b* are magnetically connected to each other by a pair of legs 37*a* and 37*b* of the second magnetic member 32, as shown in FIG. 1. These reluctances are also magnetically connected to magnetic reluctances 39*a* and 39*b* by the pair of legs 34*a* and 39*b* of the first magnetic member 31. Thus, the magnetic reluctances 38*a*, 38*b*, 39*a* and 39*b* are connected in parallel with each other as illustrated in FIG. 2. Since the first and second magnetic members 31 and 32 are coupled together at their top portions by the legs 33*a* and 33*b* as shown in FIG. 1, the magnetic schematic will be as illustrated in FIG. 2. The magnetic reluctances 38*a*, 38*b*, 39*a* and 39*b* vary due to the fact that the magnet 23 moves about the pivot support shaft 24*b*.

In the magnetic circuit represented by FIG. 2, the magnetic reluctances 38*a* and 39*a* are not directly connected together from the magnetic point of view, and thus there will be no magnetic path which will pass through the magnetic reluctances 38*a* and 39*a*. Also, there will be no direct magnetic path formed through the magnetic reluctances 38*b* and 39*b*. Thus, the magnetic flux originating from the magnet 23 will pass only through the magnetic path from the second magnetic member 32 to the first magnetic member 31, and the magnetic flux is in the direction of the arrows a illustrated in FIG. 2.

Figure 3A:
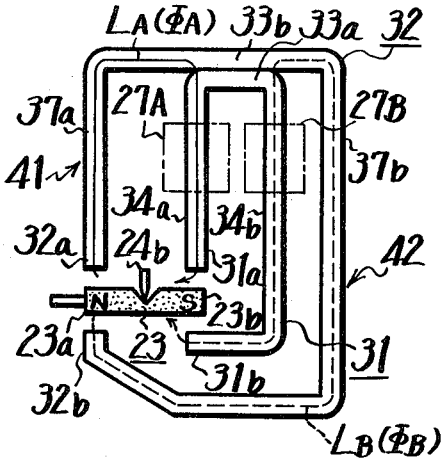
FIGS. 3A and 3C, inclusive, are respectively, views of parts of the pickup cartridge shown in FIG. 1 used for explaining the operation of the pickup cartridge shown in FIG. 1.
Figure 3B:
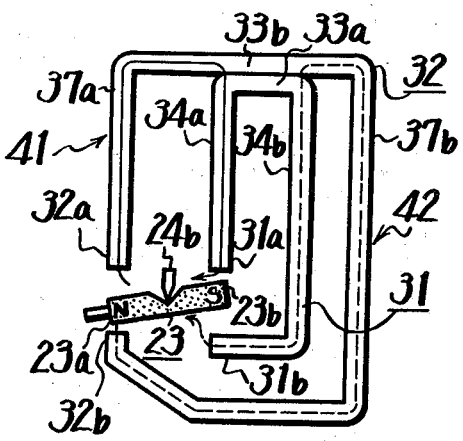
Figure 3C:
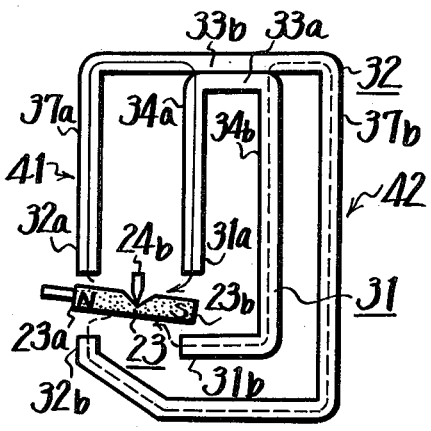

FIGS. 3A, 3B and 3C illustrate the magnetic flux in the pickup cartridge 20 for various positions of the magnet 23. In FIG. 3A, the magnet 23 is in the center non-displaced position, and the magnetic flux from the permanent magnet 23 passes from the north pole 23*a* in equal amounts into the pole pieces 32*a* and 32*b* of the magnetic member 32. A first magnetic path between the north and south poles of the magnet 23 is shown in solid line in FIG. 3A and extends from the north pole 23*a* of the magnet through pole piece 32*a*, leg 37*a*, then through leg 34*a* of magnetic member 31 through the pole piece 31*a* to the south pole 23*b* of the magnet. This magnetic path is designated as $L_A$. A second magnetic path $L_B$ is shown in dash line in FIG. 3A, and extends from the north pole 23*a* into the pole piece 32*b* through leg 37*b* and into leg 34*b* of magnetic member 31 to pole piece 31*b* and then to the south pole 23*b* of magnet 23. The small arrows adjacent the south pole 23*b* of the magnet illustrate the direction of the fluxes $\Phi a$ and $\Phi b$ of the magnetic paths $L_A$ and $L_B$. With the magnet 23 in its center position shown in FIG. 3A, the $\Phi_A$ and $\Phi_B$ will be substantially equal.

As the stylus causes the magnet 23 to be displaced to the position shown in FIG. 3B, wherein the north pole 23*a* moves closer to the pole piece 32*b* than it is to pole piece 32*a* and the south pole 23*b* moves closer to the pole piece 31*a* than it is to pole piece 31*b*, the magnetic fluxes $\Phi_A$ and $\Phi_B$ will vary in magnitude with $\Phi_A$ being greater than $\Phi_B$. On the other hand, when the magnet 23 takes the position shown in FIG. 3C, wherein the north pole 23*a* moves closer to pole piece 32*a* that it is to pole piece 32*b*, and the south pole 23*b* moves closer to the pole piece 31*b* than it is to pole piece 31*a*, the flux $\Phi_A$ will be less than $\Phi_B$. However, in all three conditions illustrated in FIGS. 3A, 3B and 3C, the fluxes $\Phi_A$ and $\Phi_B$ will maintain the same direction.

It is to be noted that the first magnetic path is formed of the leg 34*a* of the first magnetic member 31, a portion of the leg 33*b* of the second magnetic member and the leg 37*a* of the second magnetic member, and this magnetic path can be secondarily designated as magnetic member 41. The second closed magnetic path $L_B$ is formed of the leg 34*b*, a portion of the leg 33*b* and the leg 37*b* of the second magnetic member 32, and this second path can be designated as a magnetic member 42.

As shown in FIG. 1, the coils 27A and 27B are respectively wound on the legs 34*a* and 34*b* forming the first magnetic member 31 and since almost all of the magnetic flux from the magnet 23 passes through these legs, and wherein the directions of the magnetic fluxes passing through the legs 34*a* and 34*b* are in the same direction or downwardly relative to FIGS. 3A, 3B and 3C, such that very small changes of magnetic flux caused by very small displacements of the stylus 21 and the magnet 23 can be detected thus substantially increasing the sensitivity of the magnetic pickup.

Figure 4:
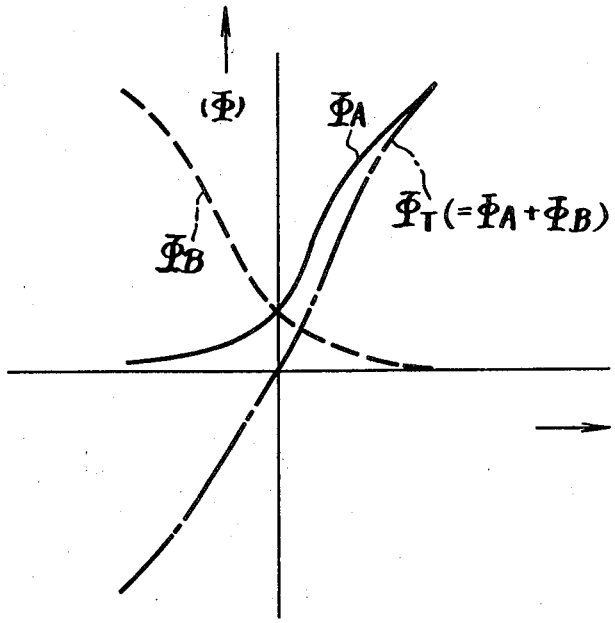
FIG. 4 is a graph showing the variation of magnetic flux.

FIG. 4 illustrates the changes of the magnetic fluxes as detected by the coils 27A and 27B on the legs 34*a* and 34*b*. Displacement is plotted in the horizontal direction in the graph of FIG. 4 and flux is plotted in vertical direction. The solid line in the graph of FIG. 4 illustrates the variations of $\Phi_A$ with displacement of the magnet 23, and the dash line illustrates variations of the flux $\Phi_B$. The variation of the composite magnetic flux $\Phi_T$ ($\Phi_A + \Phi_B$) is illustrated in one dash-dot chain line curve of FIG. 4 and is obtained by differentially connecting the coils 27A and 27B. Since the magnetic fluxes $\Phi_A$ and $\Phi_B$ are differentially derived the linearity of the composite magnetic flux $\Phi_T$ is substantially improved as shown by FIG. 4, and thus, an electrical output signal having less distortion can be obtained from the output of the pickup 20.

Since, the described above, nearly all of the magnetic flux $\Phi$ from the magnetic 23 passes through the legs 34*a* and 34*b* on which the coils 27A and 27B are wound in the same direction, the sensitivity of the pickup cartridge of the invention is substantially greater than those of prior art pickup cartridges. The electrical output signal produced by the pickup of the invention has a superior linearity characteristic and results in less distortion that the prior art devices. Thus, the pickup of the present invention has characteristics which are substantially superior to those of the prior art pickups.

A further advantage of the present invention is that since the coils 27A and 27B are differentially connected, the effects of external magnetic fields will be cancelled due to the connections of the coils 27A and 27B, and the pickup cartridge of the invention will be substantially immuned to external magnetic fields. In addition, since the coils 27A and 27B are wound on the legs 34*a* and 34*b* which are mounted inside the legs 37*a* and 37*b*, the coils will be protected and shielded from external magnetic fields and thus, the effect of external magnetic fields will be negligible upon the pickup of the invention.

Figure 5:
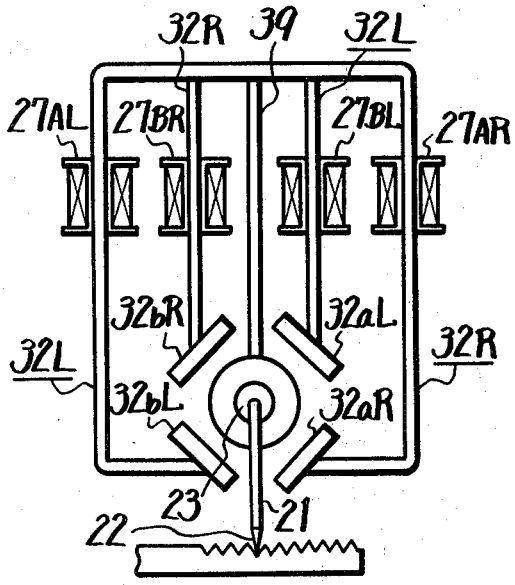
FIG. 5 is a schematic diagram showing the pickup cartridge of the invention when used as a stereophonic pickup cartridge.

FIG. 5 illustrates a modification of the invention as adapted as a pickup cartridge for stereophonic pickup in which four pole pieces 32*a*R, 32*b*R, 32*a*L and 32*b*L are mounted about the magnet 23 with 90° spacings so that as the cantilever 21 moves the magnet 23 the left and right stereophonic signals L and R will be detected. For purposes of simplicity in FIG. 5, all of the pole pieces which are mounted adjacent the north pole 23*a* of the magnet 23 are shown, and it is to be realized, of course, that there will be pole pieces mounted adjacent the south pole 23*b* of the magnet 23 in a plane which is parallel to the plane of the sheet of FIG. 5 and offset in a direction at right angles to the plane of the sheet of FIG. 5.

In FIG. 5, the elements utilized for the left and right signals L and R are shown with numerals having suffixes L and R. Element 39 designates a separator in FIG. 5.

Figure 6:
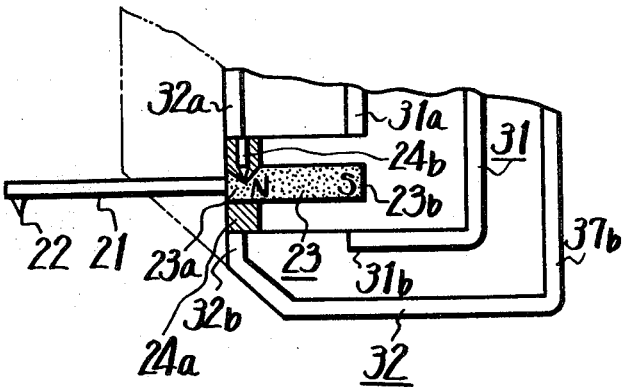
FIG. 6 is a schematic diagram, partially, in cross-section, showing a part of another embodiment of a pivot support.

FIG. 6 illustrates a modification of the invention, wherein the magnet 23 is supported adjacent its north pole 23*a* rather than in the center as in FIG. 1. The invention of this modification also has the advantages of the embodiment illustrated in FIG. 1.

It is to be realized, of course, that although in the embodiment illustrated in FIG. 1, the coils 27A and 27B are illustrated as wound on legs 34*a* and 34*b*, they could be wound on the legs 37*a* and 37*b* instead.

Although the invention has been described with respect to preferred embodiments, it is not to be so limited as changes and modifications may be made which are within the full intended scope as defined by the appended claims.

We claim as our invention:

1. A pickup cartridge comprising:

a. a cantilever with a magnet mounted thereon and said magnet having N and S poles and vibrated with said cantilever;

b. a first magnetic member having opposite ends opposing the south pole of said magnet and forming a first closed magnetic path and including first and second magnet legs forming a first closed magnetic path;

c. a second magnetic member having opposite ends opposing the north pole of said magnet and forming a second closed magnetic path, said first and second magnetic members magnetically coupled together; and d. a first coil wound on one of said legs of said first magnetic member, a second coil wound on the other leg of said first magnetic member, and said first and second coils connected differentially to each other.

2. A pickup cartridge as claimed in claim 1, in which said first magnetic member consists of said first and second magnetic legs and said second magnetic member consists of third and fourth magnetic legs, and said first, second, third and fourth magnetic legs of said first and second magnetic members formed of the same magnetic material.

3. A pickup cartridge as claimed in claim 2, in which said first magnetic member is mounted inside said second magnetic member.

4. A pickup cartridge comprising:

a. a frame member;

b. a permanent magnet pivotally supported on said frame member and mounted on a cantilever said frame member and mounted on a cantilever which moves it relative to said frame member;

c. a first magnetic member attached to said frame and having first and second legs with ends which terminate on opposite sides of the south pole of said magnet, d. a second magnetic member attached to said frame and having third and fourth legs with ends which terminate on opposite sides of the north pole of said magnet;

e. intermediate portions of said first and second magnetic members magnetically coupled together; and f. a first coil mounted on said first leg, a second coil mounted on said second leg and said first and second coils connected differentially together.

5. A pickup cartridge according to claim 4, wherein said first and second legs of said first magnetic member extend parallel to each other.

6. A pickup cartridge according to claim 4, wherein said first and second magnetic members are coupled magnetically together by a bonding agent of low magnetic reluctance which forms a bond therebetween.

7. A pickup cartridge according to claim 4, wherein said magnet is pivotally supported near its center between said north and south poles.

8. A pickup cartridge according to claim 4, wherein said magnet is pivotally supported near the north or south pole.

9. A pickup cartridge according to claim 5, wherein the magnetic flux passing through said parallel portions pass in the same direction.

* * * * *